United States Patent [19]

McGuckin et al.

[11] Patent Number: 4,943,185

[45] Date of Patent: Jul. 24, 1990

[54] COMBINED DRAINAGE AND WATERPROOFING PANEL SYSTEM FOR SUBTERRANEAN WALLS

[76] Inventors: James P. McGuckin, 6032 E. Calle de Rosa, Scottsdale, Ariz. 85251; Dean L. Bradfield, 5104 Caroli La., La Canada, Calif. 91011; Raymond A. Foltz, 27137 Rio Bosque Dr., Valencia, Calif. 91355; H. James Heidt, 2284 Waltonia Dr., #3, Montrose, Calif. 91020

[21] Appl. No.: 318,910

[22] Filed: Mar. 3, 1989

[51] Int. Cl.[5] ..... E02B 11/00; E02D 19/00; E02D 31/02

[52] U.S. Cl. ..... 405/45; 405/38; 405/43; 52/169.5; 52/169.14; 210/170

[58] Field of Search ..... 405/36, 38, 43, 45, 405/47–50; 52/169.5, 169.14; 210/170, 346, 459, 486, 496, 498

[56] References Cited

U.S. PATENT DOCUMENTS

| | | | |
|---|---|---|---|
| 2,364,621 | 12/1944 | Cross et al. | 52/169.14 X |
| 3,186,896 | 6/1965 | Clem | 405/38 X |
| 3,445,322 | 5/1969 | Saiia et al. | 405/45 X |
| 3,561,177 | 2/1971 | Agro et al. | 52/169.14 X |
| 3,654,765 | 4/1972 | Healy et al. | 52/169.5 X |
| 3,888,087 | 6/1975 | Bergsland | 405/36 |
| 4,467,015 | 8/1984 | Clem | 52/169.14 X |
| 4,490,072 | 12/1984 | Glasser | 405/45 |
| 4,574,541 | 3/1986 | Raidt et al. | 52/169.5 |
| 4,704,048 | 11/1987 | Ahlgrimm | 52/169.5 X |
| 4,730,953 | 3/1988 | Tarko | 52/169.5 X |
| 4,840,515 | 6/1989 | Freese | 405/45 |

*Primary Examiner*—Dennis L. Taylor
*Assistant Examiner*—John A. Ricci
*Attorney, Agent, or Firm*—M. David Shapiro

[57] ABSTRACT

A combination drainage and waterproofing system for subterranean walls includes panels which have drain passages on the side thereof adjacent the soil. The front surface of each panel screens against soil entering the passages and the opposite surface of each panel is waterproof and is disposed in waterproof engagement with the waterproof surfaces of adjacent panels. A variety of panel constructions are disclosed. Several modes for providing the screening surfaces and the waterproof surfaces are also disclosed.

18 Claims, 3 Drawing Sheets

COMBINED DRAINAGE AND WATERPROOFING PANEL SYSTEM FOR SUBTERRANEAN WALLS

FIELD OF THE INVENTION

This invention is concerned with protecting structures, such as walls or horizontal structures constructed of concrete or cement block, which are buried beneath the surface of the earth, or beneath a plaza structure or the like, from the deleterious effects of subterranean water.

BACKGROUND OF THE INVENTION

It has long been a practice in the building industry to attempt to waterproof the outer surface of walls and horizontal structures, such as the upper level of an underground parking garage, intended for subterranean installations. Cement block walls are quite porous and subject to seepage of water therethrough. Poured concrete walls are also porous, although to a lesser extent than the block walls. To maintain the interior of the structure dry and comfortable and to maintain the structural integrity of such walls it is essential that waterproofing be applied to the walls.

One common waterproofing technique is to coat the entire outer surface of the subterranean wall with sheets of bituminous mastic. Adhering water-impervious sheets of rubber or plastic materials to the walls is also a common waterproofing method.

Another technique which is quite effective to seal subterranean walls is the application of a layer of bentonite clay to the wall surface. This highly colloidal clay possesses the capacity to swell and gelatinize upon contact with water, thereby producing an effective water barrier. The clay is thus activated by water seeping through the soil surrounding the building structure. However, after constant exposure to flowing water, the bentonite tends to wash away.

Application of bentonite clay to wall structures is facilitated by fabricating panels in which the clay is held between water permeable sheets of paper, or the like, which are in turn fastened to the outer surface of the wall. U.S. Pat. No. 3,186,896, granted on June 1, 1976, to A. G. Clem for "Moisture Impervious Panel" discloses a bentonite clay panel for that purpose. There, two water permeable sheets are joined by a corrugated structure and the interstitial spaces are filled with the clay.

U.S. Pat. No. 3,561,177, granted on Feb. 9, 1971, to I. T. Agro, et al. for "Building Component" discloses another form of bentonite clay panel in which the clay is carried in pockets formed in a plastic carrier sheet with a rear facing permeable surface sheet covering the otherwise open cups or pockets and lying between those pockets and the wall of the protected structure. The invention depends upon water or moisture existing between the wall of the protected structure and the system of the invention to penetrate the backing sheet to expand the bentonite clay. This patent also teaches the difference between and availability of a swelling and nonswelling version of bentonite clay.

U.S. Pat. No. 3,888,087 granted to Bergsland on June 10, 1975, suggests that vertical channel protrusions along the edges of adjacently mounted sheets might be interlocked, but does not suggest or teach any sealing means therein.

These various waterproofing techniques have been effective to prevent seepage of water into and through subterranean walls. However, even with a wall that is initially waterproof, ground water seepage can cause a build-up of hydrostatic pressure against the wall which can result in severe structural damage to the wall. The counter-measure for hydrostatic pressure is the provision of a system for draining ground water away from the subterranean walls. Although drainage can be provided by means of an aggregate fill of the excavation outside the walls, that method is both costly and time consuming.

Recently, draining panels have been developed which are designed to be attached to the outer surface of a subterranean wall to permit ground water to flow along the face of the wall to a drain pipe located at the foundation of the wall.

Examples of such draining panels can be found in U.S. Pat. Nos. 3,654,765, granted on Apr. 11, 1972, to K. A. Healy, et al. for "Subterranean Wall Drain," No. 4,490,072, granted on Dec. 25, 1984, to J. Glasser for "Drainage Device", and No. 4,574,541, granted Mar. 11, 1986, to H. P. Raidt, et al. for "Foundation-Drainage Panel". The drainage panels disclosed in these three patents differ somewhat from each other, but basically they comprise a shaped core which provides vertical passages for the flow of water down the face of the wall, on at least one side of the panel, and a fabric or screen cover on one face of the panel to prevent soil from entering and clogging the drainage passages. The panels are designed to be used with a perforated drain pipe positioned at the lower end thereof for conveying away ground water diverted from the wall by the panel.

Mirafi Inc., Charlotte, North Carolina, manufactures a line of products under its trademark, "Miradrain." "Miradrain 6000" is a non-permeable plastic sheet formed with round protrusions on a first side which are bridged by a filtering material attached at the apexes of the protrusions. The product is intended for application with the open side of the protrusions placed against a subterranean wall and the filter fabric side against the back filled earth. Fluid flow is in all directions around the protrusions. There is no means suggested for sealing the edges of these panels for waterproofing purposes, but it is suggested that the panels may be mechanically interlocked by engaging a plurality of the protrusions in one panel into the back side of the protrusions in an adjacent panel. Another product of Mirafi Inc., is "Miradrain 4000," similar to "Miradrain 6000," but having round protrusions on both sides of the panel wherein the protrusions on one side are offset from those on the other. Filter fabric is applied to both sides at the flat mesa-like apexes of the protrusions. This configuration allows free water flow on either side of the panel.

Another drainage panel sold under the trademark "GeoTech Drainage Panel" by GeoTech Systems, Inc., of McLean, VA, utilizes a core board made of bonded resin beads having water flow passages therebetween.

Many of the prior art drainage panels are adaptable to application on the inner side of shoring where such shoring is utilized to retain the earth wall of an excavation in a more nearly vertical orientation. This is believed to be common practice where limitations exist on the amount of land available for excavation. Where the shoring is left in place after an underground structure is built, backfill is placed between the panel covered shoring and the new construction. Sometimes, the panel covered shoring is used as a form against which concrete may be poured; thus leaving the panel in close contact with the newly built structure.

So far as is known, the drainage panels provided in the prior art have not functioned also as a waterproofing media. Their cores provide, at most, only one line of defense against leakage, and they are not equipped to provide waterproof joints between adjacent panels. Consequently, the practice has been to use these drainage panels in combination with previously known waterproofing systems such as bituminous coatings and others discussed above. The separate application of a water-proofing system and then a drainage system to the subterranean walls of the structure has proven to be relatively costly and time consuming.

SUMMARY OF THE INVENTION

These and other disadvantages and shortcomings of the prior art have been overcome according to the instant invention which contemplates a combined drainage and waterproofing system and in which a single set of panels is installed against a subterranean wall to both waterproof the wall and to provide drainage of water away from the wall. The system of the invention also includes, as a component of the drainage panels, means for providing a self-sealing waterproof connection between adjacent panels. The system of the invention thus eliminates the requirement for a separate waterproofing step prior to the installation of the drainage panels. The invention results in a considerable savings in cost and labor time and provides the dual functions of waterproofing and draining water from a subterranean wall or other structural surface.

It is therefore, an object of the invention to provide a panel for application to an exterior of a subterranean structure which provides integral waterproofing and water shedding capabilities.

It is another object of the invention to provide a panel for application to an exterior of a subterranean structure which provides integral waterproofing and water shedding capabilities and has inherent capabilities for providing waterproof joints between a plurality of such panels.

These objects of the invention will be better understood upon study of the Detailed Description of the Preferred Embodiment of the Invention, below, taken together with the drawings in which.

Figure 1:
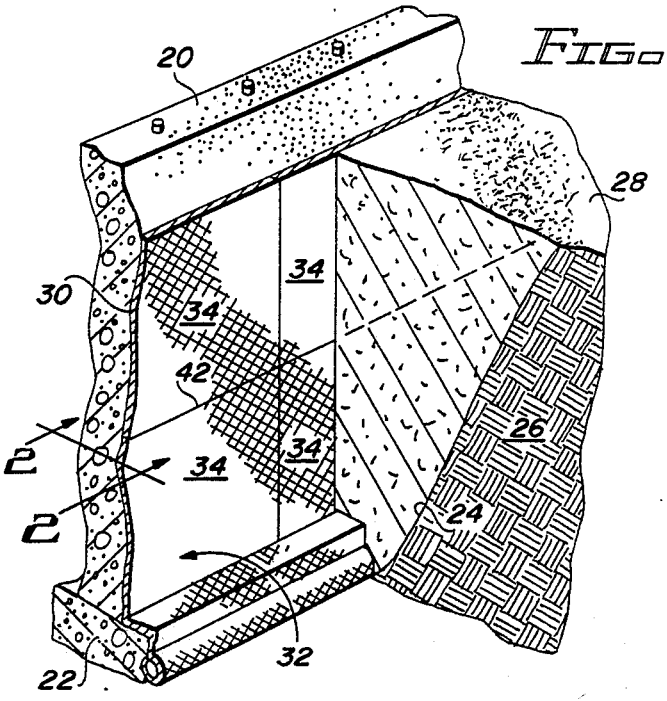
FIG. 1 is a fragmentary perspective view of a subterranean wall structure having the drainage and waterproofing system of the in applied thereto.

DETAILED DESCRIPTION OF THE PREFERRED EMBODIMENT OF THE INVENTION (It should be noted that wherever in this specification like reference numerals are used they refer to like features of the invention. Wherever an alphabetic suffix is appended to such reference numerals, it indicates a variation of or a different version of the same reference numeral which does not carry such suffix.)

Referring particularly to FIG. 1, the numeral 20 designates a wall resting on a footing 22 in an excavation in a body of earth 26. Backfill 28, including soil material, closes the space between the wall 20 and the excavation wall 24. The wall 20 is thus in a subterranean location where the exterior surface 30 of the wall is subjected to any ground water contained within backfill 28.

To prevent ground water from leaking through the wall 20 and to prevent the build-up of hydrostatic pressure against the wall 20, the exterior surface 30 of wall 20 is protected in accordance with this invention with a system of combined waterproofing and drainage panels, designated generally by reference numeral 32, comprising individual panels 34. It may be appreciated that, while the illustrated case shows a vertical application, similar benefits would be derived from using panel system 32 horizontally or on a slope in a variety of other applications, such as planters, plaza decks, and underneath basement floors.

Figure 2:
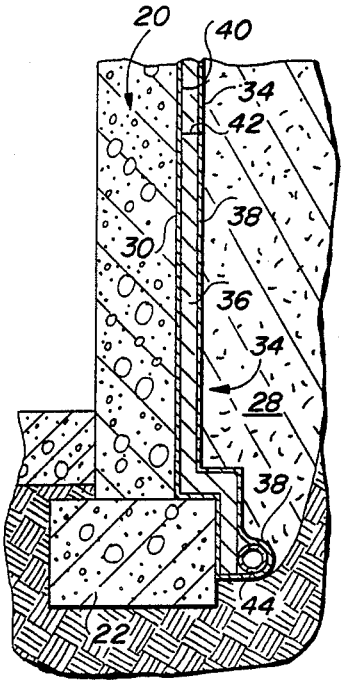
FIG. 2 is a vertical sectional view through the wall of FIG. 1 taken from 2—2.

FIG. 2 illustrates schematically the combined waterproofing and drainage system shown in FIG. 1, consisting of individual panels 34. Each panel 34 is composed of three functional layers. In the middle a drainage core 36 has water flow passageways formed therein which permit water to flow downward through the panel on the front or outer side of core 36. Filter material 38 on the front side of drainage core 36 permits water to enter the interstitial flow passageways in the drainage core 36 but prevents any significant movement of the soil backfill 28 or of individual soil particles into those passageways so that the passageways do not become restricted or clogged with silt. On the back side of the drainage core 36 is a waterproofing material 40 which prevents water from reaching the exterior surface 30 of wall 20. The joints 42 between panels 34 are the fourth functional component of the system. Joints 42 must maintain the continuity of the drainage, waterproofing, and filtration functions from one panel 34 to the next.

The combined drainage and waterproofing system shown in FIG. 2 may terminate at the top of footing 22, or, preferably, cover the outer surface of footing 22 as shown. If large flows of drainage are anticipated, perforated drain pipe 44 may be added at the lower end of system 32 for rapidly conveying the collected flow away from the wall 20. The bottom panel 34 of system 32 preferably has an excess of filter material 38 which may be wrapped around drain pipe 44 to prevent soil particles from entering the perforations and clogging the pipe.

Figure 3:
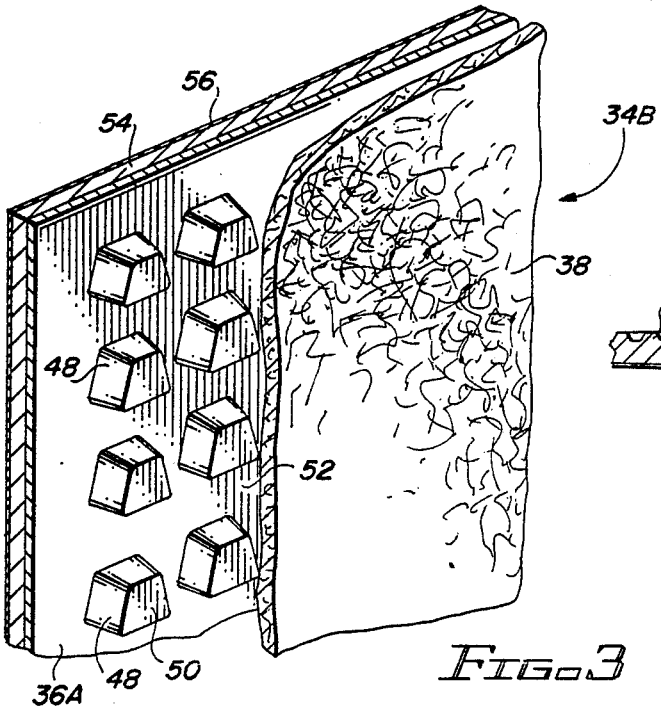
FIG. 3 is a perspective view of a drainage and waterproofing panel constructed with a drainage core formed of rigid sheet plastic, and with an integral granular waterproofing material, in accordance with the invention.

FIGS. 3, 4, 5, and 6 illustrate a particularly effective construction for panels 34B capable of producing the drainage and waterproofing system 32 shown in FIGS. 1 and 2. In this structure, the drainage core 36A consists of a plastic sheet material having a plurality of spaced protrusions 48 formed therein. The spaces between protrusions 48 provide water flow passageways 52 which allow water to enter the front face of drainage core 36A via filter material 38 and then to drain downward across the face of core 36A. Protrusions 48 and passageways 52 may be shaped as shown in FIG. 3, but a variety of other shapes that serve the drainage function may be envisioned, including continuous ridges or grooves that create a corrugated profile. Such ridges or grooves may be oriented either vertically or both vertically and horizontally. A filter material 38 is glued or otherwise affixed to the flat mesa-like apexes 50 of protrusions 48, so that soil is prevented from entering the flow passageways 52 of drainage core 36A. Filter material 38 is preferably made from a permeable woven or non-woven filter fabric. A waterproofing material 54 is affixed to the back side of drainage core 36A, filling the hollow backs of the protrusions 48 and covering the back face of drainage core 36A. Waterproofing material 54 is preferably composed of a self-healing material, such as granular bentonite clay or hydrophilic rubber, which expands in the presence of water to create a water impervious gel. This self-healing waterproofing material may be composed of granules which may be bonded to each other and to drainage core 36A with adhesive. An optional protection sheet 56 of thin, permeable paper or fabric, preferably biodegradable, may be adhered to the exposed surface of the waterproofing material 54, to help prevent the waterproofing from being damaged or scraped away during handling and installation of the panels 34B. Because the waterproofing material 54 is self-healing, panel 34B may be affixed in place with nails driven completely through the panel 34B into the wall 20 shown in FIG. 1.

As in prior art drainage panel use, the panels of the invention may also be applied to the inside of a shoring system where such shoring is used to limit the amount of excavation in a given construction site, or, directly to the earth face of an excavation, where the excavation lends itself to that kind of application. (Not shown.) Where the shoring also acts as one side of the concrete pouring form, the panels of the invention are applied before concrete pouring to facilitate intimate contact with the new structure. Generally, the shoring is left in place, even after cure of the new concrete.

Figure 4:
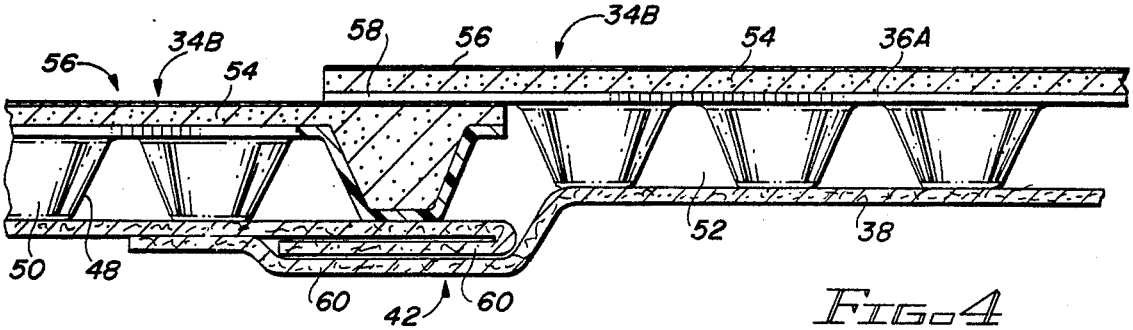
FIG. 4 is a sectional view of two of the panels of FIG. 3, illustrating the manner in which adjacent panels of the type illustrated in FIG. 3 can be joined in a waterproof relationship by means of a flat flange at the edge of each such panel.

FIG. 4 illustrates a manner in which the joint 42 of FIG. 1 may be constructed between adjacent panels 34B which are configured as shown in FIG. 3. When adjacent panels 34B are brought together during installation, they may be overlapped in such a manner that the waterproofing material 54 or optional protection sheet 56 on the back surface of one of the panels 34B comes into continuous and intimate contact with the front surface of a flat flange 58 formed on the periphery of the drainage core 36A of the adjacent panel 34B. A peripheral flap 60 of filter material 38 on each panel 34B extends beyond the four edges of the drainage cores 36A so that the filter material 38 of one panels 34B may overlap the filter material 38 of an adjacent panel 34B; or wrap around an edge of a peripheral panel 34B (not shown) or around a perforated drain pipe 44 (see. FIG. 2) in the event that the panel 34B is located at one of the peripheral edges of the drainage and waterproofing system 32 (see, FIG. 1).

Figure 5:
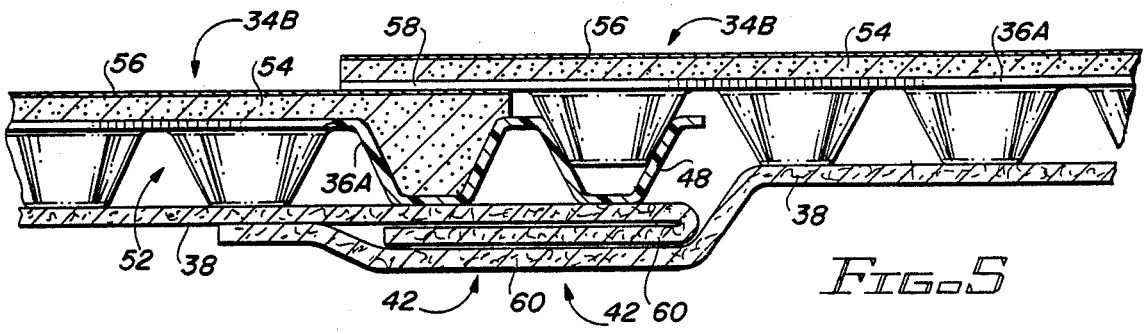
FIG. 5 is a sectional view illustrating an alternative manner, involving a mechanical interlock, in which adjacent panels of the type illustrated in FIG. 3 can be joined in waterproof relationship to each other.

FIG. 5 illustrates an alternative manner in which the joint 42 of FIG. 1 may be constructed between adjacent panels 34B which are configured as shown in FIG. 3. This joint is distinguished by a mechanical interlock, made possible by leaving the waterproofing material 54 out of the hollow back sides of the protrusions 48 at the edges of the panel 34B. When adjacent panels 34B are brought together, they may then be overlapped in such a manner that some of the protrusions 48 formed in an edge region of one of the drainage cores 36A are interlocked with, i.e., project into, the hollow back sides of protrusions 48 on the edge of the adjacent drainage core 36A. A flat peripheral flange 58 is again included to help make sure that the joint is completely watertight. A peripheral flap 60 of filter material 38 again extends beyond the four edges of the drainage core 36A for overlap purposes.

Figure 6:
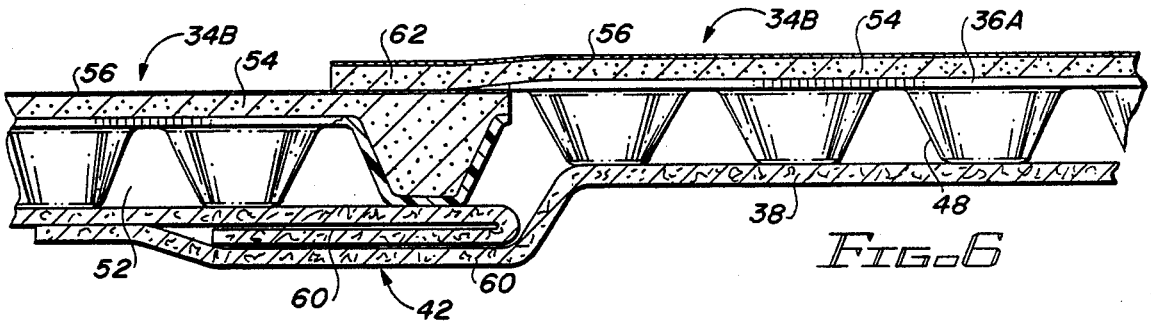
FIG. 6 is a sectional view of yet another means, involving a waterproof flap, by which adjacent panels of the type illustrated in FIG. 3 may be joined in waterproof relationship to each other.

FIG. 6 illustrates still another manner in which the joint may be constructed between adjacent panels 34B which are configured as shown in FIG. 3. When adjacent panels 34B are brought together, they may be overlapped in such a manner that one of the panels 34B overlaps and comes into intimate contact with a waterproofing flap 62 extending from the back side of the adjacent panel 34B. The waterproofing flap 62 is provided by allowing the waterproofing material 54 and protection sheet 56 to extend beyond the edge of the drainage core 36A. This waterproofing flap 62 may be used alone, or in conjunction with either the flat flange 58 illustrated in FIG. 4 or the mechanically interlocking joint illustrated in FIG. 5. A peripheral flap 60 of filter fabric is provided as before.

Figure 8:
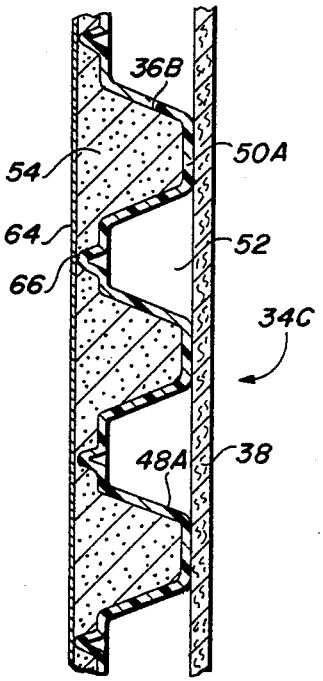
FIG. 8 is sectional view taken from 8—8, further illustrating the panel of FIG. 7.
Figure 7:
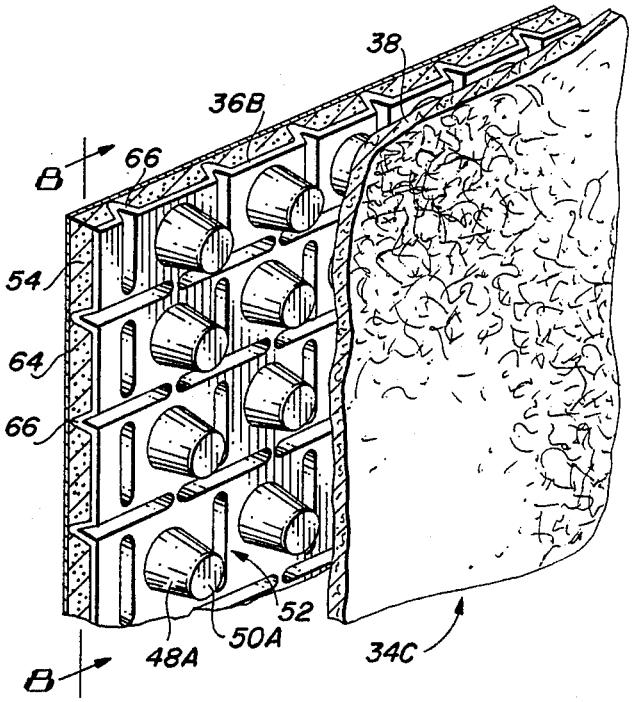
FIG. 7 is a perspective view of another panel construction, utilizing granular waterproofing particles encapsulated between the drainage core and a backer sheet.

FIGS. 7 and 8 (a cross-section of FIG. 7, taken from 8—8), illustrate a somewhat different configuration for constructing panels 34C capable of producing the drainage and waterproofing system shown in FIGS. 1 and 2. This embodiment is characterized by the addition of a backer sheet 64, bonded to the back side of a drainage core 36B, so that the waterproofing material 54, which may comprise loose granular material, is encapsulated between the backer sheet 64 and the drainage core 36B. Specifically, the drainage core 36B again consists of a relatively rigid plastic sheet material having a plurality of spaced protrusions 48A formed therein. The spaces between protrusions 48A provide water flow passageways 52, and filter material 38 is affixed to the apexes 50A of protrusions 48A to retain soil particles while allowing water to enter flow passageways 52. On the back side of drainage core 36B, a self-healing waterproofing material 54 is encapsulated between the drainage core 36B and a backer sheet 64 made of thin, permeable paper or fabric, which is preferably biodegradable. The backer sheet 64 is adhered to the back side of the drainage core 36B at spaced locations corresponding to the low points 66 between protrusions 48A. In order to maximize the surface area of the waterproofing material 54 that is in contact with the backer sheet 64, the surface area of the low points 66 should be kept to a minimum. That is why the drainage core 36A shown in FIG. 3 would not be a suitable configuration for this embodiment. It may again be appreciated that a variety of different shapes of protrusions 48 and passageways 52 may be envisioned including continuous ridges that create a corrugated profile, many of which would serve the drainage function and satisfactorily encapsulate the waterproofing material. The manner in which joints 42 may be constructed between adjacent panels 34C would be the same as the manner illustrated in FIG. 4, including the peripheral flange 58 shown therein, or in FIG. 5, including the peripheral flange 58 and the mechanically interlocking dimples 48.

All of the embodiments discussed to this point may preferably have a total panel thickness of about ½ inch. The panels 34 may be on the order of four feet by four feet in their long dimensions. The filter fabric 38 may have a thickness of about 50 mils and the colloidal clay or granular bentonite may be from approximately 1/16 to 3/16 inches in thickness, except where it is used to fill the back side of the protrusions 48. While these dimensions are to be considered somewhat typical, it will be clear to one of ordinary skill in the art that the dimensions are a matter of design choice and may be varied considerably to suit any particular application requirements.

Figure 9:
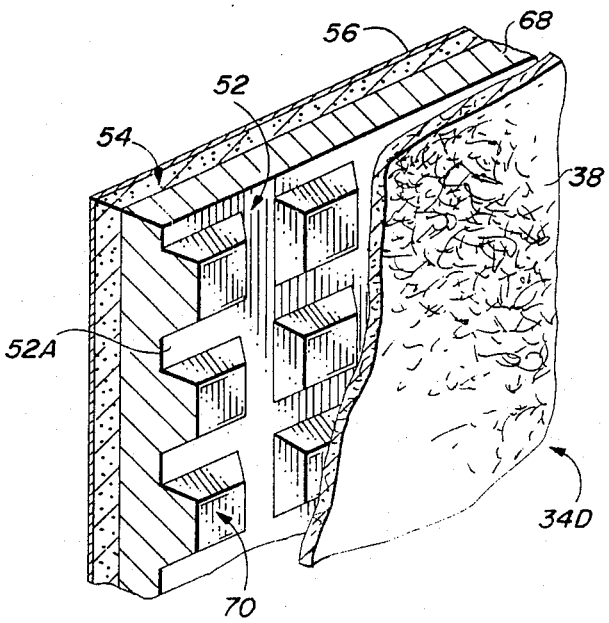
FIG. 9 is a perspective view of another panel construction, utilizing a solid drainage core.
Figure 10:
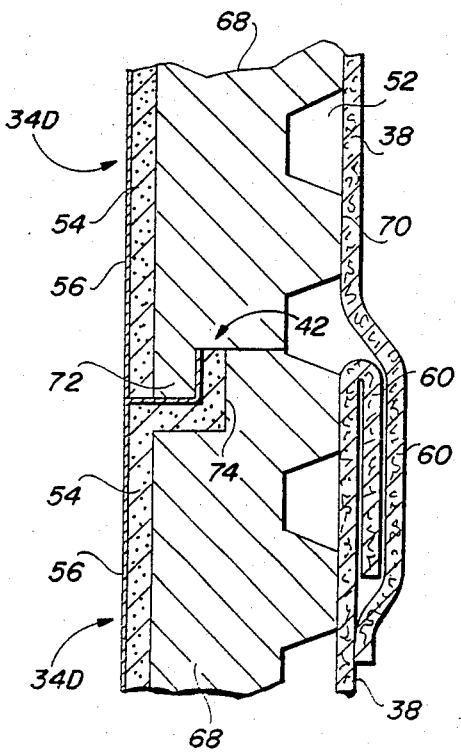
FIG. 10 is a sectional view of one means, using a tongue and rabbet joint, by which adjacent panels of the type in FIG. 9 can be joined in waterproof relationship to each other.
Figure 11:
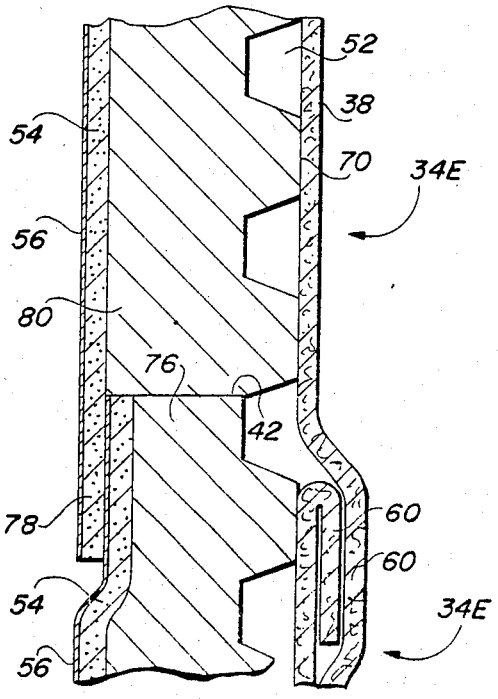
FIG. 11 is a sectional view of an alternative manner in which adjacent panels of the type illustrated in FIG. 9 may be joined in waterproof relationship to each other by use of a waterproof flap.

Another panel construction 34D with the added benefit of thermal and sound insulation is illustrated in FIGS. 9, 10, and 11. In this embodiment, the drainage core 68 is formed of plastic foam, such as expanded or extruded polystyrene, having vertical grooves and ridges on the front face thereof providing water flow passageways 52. Of course, such a panel could also be fabricated with a combination of vertical and horizontal grooves and ridges. It is thicker than the drainage core structures (36 and variations 36A and 36B) described to this point. Horizontal grooves may also be provided, as shown. The entrance to flow passageways 52 is screened by a filter material 38 affixed to the front faces 70 of the drainage core 68 by means of one of the many adhesives which are known in the art which do not attack the particular plastic foam material used for drainage core 68. (It is well known that beaded and foamed polystyrene materials are subject to attack by many solvents commonly found in adhesives. The substitution of a polyurethane foam material for drainage core 68 would eliminate that problem for the most part; that material being much more resistant to such solvents, however, it is also well known that the polyurethane foam is more expensive.) The back of drainage core 68 is covered by a body of self-healing waterproofing material 54, such as bentonite clay or hydrophilic rubber. The waterproofing material 54 may be composed of granules, which may be bonded to each other and to the drainage core 68 with adhesive. An optional protection sheet 56 of thin, permeable paper or fabric, may be adhered to the exposed surface of the granules 54 to help prevent them from being scraped away during handling and installation.

Alternatively, the waterproofing material 54 may consist of a layer of mastic material, bonded to the drainage core 68 by nature of the mastic's natural adhesive qualities or with the aid of a primer adhesive. The protection sheet 56 in this case may be a release film of coated paper or plastic that would be removed immediately prior to installing the panel 34D.

FIG. 10 illustrates a preferred manner in which the joint 42 of FIG. 1 may be constructed between adjacent panels 34D which are configured as shown in FIG. 9. When adjacent panels 34D are brought together during installation, they may be overlapped in such a manner that the protruding tongue 72 extending out from the back edge of one of the drainage cores 68 makes contact within the mating notch or rabbet 74 provided in the back edge of the adjacent drainage core 68. The mating notch or rabbet 74 is completely covered with waterproofing material 54, and the protruding tongue 72 may be partially or completely covered (not shown) with waterproofing material 54 as well. The optional protection sheet 56 may cover the exposed face of the waterproofing material 54. A peripheral flap 60 of filter material 38 on each panel 34D extends beyond the four edges of the drainage core 68 to provide a continuous overlap at the joint and to wrap around the edge of the panel 34D or around a perforated pipe 44 (see. FIG. 2) as appropriate.

FIG. 11 illustrates an alternative manner in which the joint may be constructed between adjacent panels 34E which are configured as shown in FIG. 9. When adjacent panels 34E are brought together, they may be overlapped in such a manner that one of the panels 34E overlaps and comes into intimate contact with a waterproofing flap 78 extending from the back side of the adjacent panel 34E. The waterproofing flap 78 is provided by allowing the waterproofing material 54 and protection sheet 56 to extend beyond the edge of the panel 34E. A peripheral flap 60 of filter material 38 is provided as before. At least one edge area 76 of each panel 34E is made to be thinner than an opposite edge 80 so that waterproofing material 54 may be doubled in thickness adjacent joint 42 and still allow a flat surface contact at wall 20 (see, FIG. 1).

Figure 12:
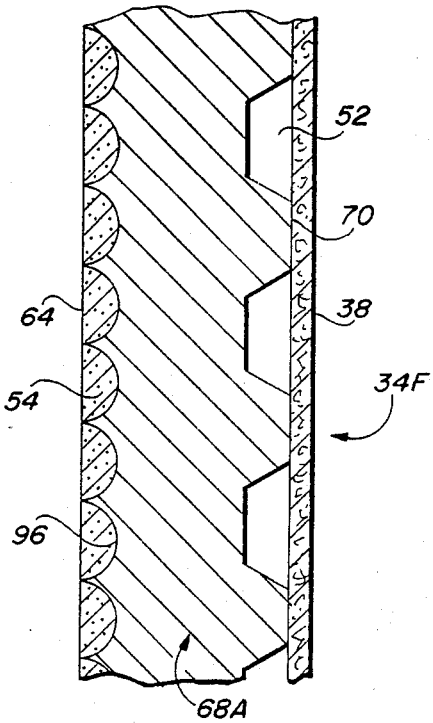
FIG. 12 is a sectional view of an alternative panel core, similar to that of FIGS. 9, 10 and 11, but having a grooved rear face.

Still another variation of panel 34F appears in cross-section in FIG. 12. There, a rigid board core 68A, similar to core 68 used in the embodiment of FIGS. 9–11, is provided, but with molded channels 96 in the back face thereof. Waterproofing material 54 is applied in channels 96 and is encapsulated by backer sheet material 64 which is adhered to core 68A.

It will be understood, then, that core 36 (36A, 36B, 36C, 36D, 68, 68A) of panel 34 may be made of any of many different materials and may take any of many different forms.

Figure 13:
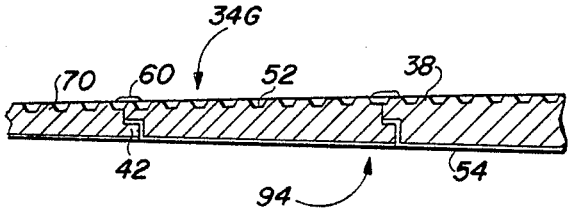
FIG. 13 is a sectional view of a tapered filler board system for application to near horizontal surfaces to provide gravity drainage through the panels of the invention.

It will also be understood that the panels described herein may be mounted to any flat surface for the purpose of draining and shedding water from that surface. The flat surface may be a vertical or horizontal surface or it may be a sloped surface with respect to either a vertical or horizontal reference. In some applications, it may be advantageous to apply the panels of the invention to the top of a horizontal surface or structure 94 in such a way as to further induce drainage and seal water away from that surface. See, FIG. 13. This may be accomplished by using tapered panels 34G, thus providing a non-horizontal panel 34 surface for positive gravity drainage over the horizontal structural surface 94 to be protected.

From the foregoing it should be apparent that this invention provides a variety of structures capable of providing the dual function of waterproofing and providing drainage for a subterranean wall installation. Moreover, it will be appreciated that because the system utilizes a composite panel structure it permits a one-step installation providing a combination drainage and sealing function which reduces the time and cost of installing the system. A variety of configurations are also provided for constructing the joints between panels, such that the joints remain watertight and the filter material provides continuous screening across the joint.

While the invention has been particularly shown and described herein with reference to a preferred embodiment thereof, it will be understood by those skilled in the art that various other modifications and changes may be made to the present invention from the principles of the invention as herein described without departing from the spirit and scope as encompassed in the accompanying claims. Therefore, it is intended in the appended claims to cover all such equivalent variations which may come within the scope of the invention as described.

What is claimed is:

1. A combination drainage and waterproofing system for application to and protection of subterranean structures, such as walls, plaza decks or the like, the system comprising a plurality of composite panels, each of the plurality of composite panels further comprising:

a drainage core, said drainage core having a front surface and a back surface and a plurality of edges thereof, said front surface having a plurality of protrusions thereon, each of said plurality of protrusions having an apex on a front surface thereof, said plurality of protrusions forming interstitial passageways therebetween for permitting transverse flow of water across said front surface of said drainage core;

filter means for prevention of admission of earth particles into said interstitial passageways, said filter means being adhered to said apexes of said plurality of protrusions;

means for waterproofing said back surface of said drainage core; and means for sealing at least one of said plurality of edges of said drainage core to an edge of a like adjacent drainage core, whereby a continuous waterproof surface is presented at said rear surface of a plurality of said drainage cores when said plurality of back surfaces of said drainage cores are placed adjacently against the subterranean structure, wherein said means for waterproofing said back surface of said drainage core comprises a flat peripheral flange formed on and as part of at least one edge of said drainage core, said flat peripheral flange being overlapped by a portion of an adjacent one of said drainage cores so that the front surface of said flat peripheral flange is brought into intimate contact with a portion of said back surface of said adjacent drainage core.

2. The system according to claim 1 wherein said filter means extends beyond at least one of said plurality of edges of said drainage core, wherein said filter means may be made to overlap said filter means on an adjacently placed another of said drainage cores to provide a continuous filter means across said front surfaces of said drainage core and said another drainage core.

3. The system according to claim 1 wherein each of said drainage cores of the plurality of drainage cores is formed of a sheet plastic material having said plurality of protrusions formed therein, each of said plurality of protrusions having a corresponding hollow in said back surface of each of said plurality of said drainage cores.

4. The system according to claim 3 wherein said means for waterproofing said back surface of said drainage core comprises granular particles of a free-swelling, self-healing waterproofing material which fill each of said corresponding hollows in said back surface of each of said plurality of protrusions formed in said drainage core and completely covers said back surface of said drainage core, adjacent ones of said granular particles being adhered each to the other.

5. The system according to claim 4 wherein said means for waterproofing said back surface of said drainage core further comprises a mechanical interlock, wherein at least one of said plurality of protrusions is located on said front surface of said peripheral flange of said drainage core and wherein at least one of said plurality of protrusions may be interlocked with at least one of said corresponding hollows of another of said drainage cores.

6. The system according to claim 4 wherein the means for waterproofing comprises a waterproof flap, said waterproof flap comprising a protective sheet of water permeable material adhered to an exposed back surface of said waterproofing material and a front surface of said flap being coated with some of said waterproofing material and said protective sheet extends beyond at least one edge of each of said drainage cores, said waterproof flap overlapping an adjacent drainage core thereby bringing said waterproofing material on said front face of said waterproof flap into intimate contact with said waterproofing material on said back surface of said adjacent panel.

7. The system according to claim 5 wherein said granular particles of waterproofing material are protected from being scraped off during shipment and installation by means of a water permeable sheet material which is adhered to and completely covers said granular particles.

8. The system according to claim 4 wherein said granular particles of waterproofing material are protected from being scraped off during shipment and installation by means of a water permeable sheet material which is adhered to and completely covers said granular particles.

9. The system according to claim 3 wherein said means for waterproofing said back surface of said drainage core comprises loose granular particles of a free-swelling, self-healing waterproofing material which nearly fill each of said corresponding hollows in said back surface of each of said plurality of protrusions formed in said drainage core and nearly completely covers said back surface of said drainage core, wherein said loose granular particles of waterproofing material are held in place by means of a water permeable sheet material which is adhered to a relatively small exposed portion of said back surface of said drainage core and said water permeable sheet material completely covers said granular particles.

10. The system according to claim 9 wherein said means for waterproofing said back surface of said drainage core further comprises a mechanical interlock, wherein at least one of said plurality of protrusions is located on said front surface of said peripheral flange of said drainage core and wherein at least one of said plurality of protrusions may be interlocked with at least one of said corresponding hollows of another of said drainage cores.

11. The system according to claim 1 wherein said drainage core is composed of a solid material, such as foam plastic, said drainage core having protrusions formed on the front face thereof to provide said passageways.

12. The system according to claim 11 wherein said means for waterproofing said back surface of said drainage core comprises granular particles of a free-swelling, self-healing waterproofing material which completely covers said back surface of said drainage core, adjacent ones of said granular particles being adhered each to the other.

13. The system according to claim 12 wherein the means for sealing each of said plurality of edges of said drainage cores comprises a rabbeted joint, a front facing surface of a protruding tongue being in intimate contact with said means for waterproofing on the backward-facing surfaces of a mating surface in said adjacent panel.

14. The system according to claim 13 wherein said protruding tongue is covered with said waterproofing means.

15. The system according to claim 13 wherein said granular particles are protected from being scraped off during shipment and installation by means of a water permeable sheet of one of paper and fabric which is adhered to and completely covers said granular particles.

16. The system according to claim 12 wherein said granular particles are protected from being scraped off during shipment and installation by means of a water permeable sheet of one of paper and fabric which is adhered to and completely covers said granular particles.

17. The system according to claim 12 wherein the means for waterproofing comprises a waterproof flap, said waterproof flap comprising a protective sheet of water permeable material adhered to an exposed back surface of said waterproofing material and a front surface of said flap being coated with some of said waterproofing material and said protective sheet extends beyond at least one edge of each of said drainage cores, said waterproof flap overlapping an adjacent drainage core thereby bringing said waterproofing material on said front face of said waterproof flap into intimate contact with said waterproofing material on said back surface of said adjacent panel.

18. The system according to claim 17 wherein said solid material has a plurality of hollows in said back surface thereof, and wherein said means for waterproofing said back surface of said drainage core comprises loose granular particles of a free-swelling, self-healing waterproofing material which nearly fill each of said plurality of hollows in said back surface of said drainage core and nearly completely covers said back surface of said drainage core, wherein said loose granular particles of waterproofing material are held in place by means of a water permeable sheet material which is adhered to a relatively small exposed portion of said back surface of said drainage core and said water permeable sheet material completely covers said granular particles.

* * * * *